US012180708B2

(12) United States Patent
Tolson

(10) Patent No.: US 12,180,708 B2
(45) Date of Patent: Dec. 31, 2024

(54) LOFT CONVERSION

(71) Applicant: Tommy Tolson, Leeds (GB)

(72) Inventor: Tommy Tolson, Leeds (GB)

( * ) Notice: Subject to any disclaimer, the term of this patent is extended or adjusted under 35 U.S.C. 154(b) by 0 days.

(21) Appl. No.: 17/316,066

(22) Filed: May 10, 2021

(65) Prior Publication Data

US 2021/0262224 A1 Aug. 26, 2021

Related U.S. Application Data

(63) Continuation of application No. PCT/GB2019/053212, filed on Nov. 13, 2019.

(30) Foreign Application Priority Data

Nov. 13, 2018 (GB) ..... 1818470

(51) Int. Cl.
*E04C 3/18* (2006.01)
*E04B 1/19* (2006.01)
(Continued)

(52) U.S. Cl.
CPC ..... *E04B 7/022* (2013.01); *E04C 3/18* (2013.01); *E04B 1/19* (2013.01);
(Continued)

(58) Field of Classification Search
CPC . E04B 7/022; E04C 3/18; E04C 3/292; E04C 3/17; E04G 23/027; E04G 23/0218; E04G 2023/0248
See application file for complete search history.

(56) References Cited

U.S. PATENT DOCUMENTS 1,453,996 A * 5/1923 Riddle ..... E04C 3/29 52/376
1,711,163 A * 4/1929 Zabriskie ..... E04F 15/00 52/483.1
(Continued)

FOREIGN PATENT DOCUMENTS

EP 1445392 A2 8/2004
FR 2304734 A1 10/1976
(Continued)

OTHER PUBLICATIONS

International Search Report and Written Opinion for International Application No. PCT/GB2019/053212 mailed May 14, 2020 (15 pages).

*Primary Examiner* — Phi D A
(74) *Attorney, Agent, or Firm* — Nutter McClennen & Fish LLP

(57) ABSTRACT

In carrying out a loft conversion some way has to be found of reinforcing the triangular timber roof trusses so that the internal bracing can be removed, to make the space. In the invention this is done by fixing C-sections to the outline of the triangular trusses, preferably sandwiching the timber frame. For the C-sections to overlap at the corners, part of one flange, e.g., the upper flange of the horizontal beam, is removed, and then the beams are bolted onto the frame. The process can be carried out with minimal disruption to the roof as no transverse (longitudinal) reinforcement is needed. A dormer process can also be included, making use of a versatile reinforcement plate.

19 Claims, 6 Drawing Sheets

(51) Int. Cl.

| | |
|---|---|
| ***E04B 7/02*** | (2006.01) |
| ***E04C 3/17*** | (2006.01) |
| *E04B 1/26* | (2006.01) |
| *E04C 3/14* | (2006.01) |

(52) U.S. Cl.
CPC ..... *E04B 2001/2696* (2013.01); *E04C 3/14* (2013.01); *E04C 3/17* (2013.01)

(56) References Cited

U.S. PATENT DOCUMENTS 2,099,470 A * 11/1937 Coddington ..... E04C 3/293 52/301
2,167,835 A * 8/1939 Greulich ..... E04C 3/292 52/376
2,167,836 A * 8/1939 Greulich ..... E04C 3/292 52/376
2,187,280 A * 1/1940 Olson ..... E04C 3/292 52/695
2,200,159 A * 5/1940 Davis, Jr. ..... E04C 3/08 52/690
2,387,432 A * 10/1945 Du Laney ..... E04C 3/29 D25/58
2,461,916 A * 2/1949 Omar ..... E04B 1/3447 52/641
3,263,381 A * 8/1966 Dickinson ..... E04C 3/42 52/847
3,425,720 A 2/1969 Spane
3,882,653 A * 5/1975 Ollman ..... E04B 7/00 52/694
3,950,109 A * 4/1976 Smith ..... E04B 1/49 403/403
3,969,869 A * 7/1976 Partridge ..... E04B 7/18 52/690
4,133,155 A * 1/1979 Oelrich ..... E04C 3/292 52/841
4,274,241 A * 6/1981 Lindal ..... E04B 1/26 52/642
4,435,940 A * 3/1984 Davenport ..... E04B 7/022 52/92.1
4,483,117 A * 11/1984 Underhill ..... E04C 3/17 52/639
4,676,044 A 6/1987 Terenzoni
6,167,675 B1 * 1/2001 LeBlanc ..... E04C 3/18 52/847
6,401,422 B1 * 6/2002 Olden ..... E04C 3/17 52/645
7,409,804 B2 * 8/2008 Moody ..... E04C 3/11 52/693
8,166,721 B1 * 5/2012 diGirolamo ..... E04C 3/292 52/456
11,162,262 B2 * 11/2021 Poutanen ..... E04C 3/16
2003/0014928 A1 * 1/2003 Kerney ..... E04C 3/17 52/634
2004/0103597 A1 6/2004 Ellenberger
2010/0269445 A1 * 10/2010 Gannon ..... E04C 3/17 52/645
2013/0239512 A1 * 9/2013 Yang ..... B32B 15/10 428/35.6
2014/0137485 A1 * 5/2014 Lafferty, III ..... E04G 23/0218 52/29

FOREIGN PATENT DOCUMENTS

| | | | |
|---|---|---|---|
| FR | 2877028 | A1 | 4/2006 |
| GB | 2442958 | A | 4/2008 |
| JP | S56105048 | A | 8/1981 |
| WO | 2008121961 | A1 | 10/2008 |

* cited by examiner

LOFT CONVERSION

PRIORITY

The present application is a continuation patent application of PCT Patent Application No. PCT/GB2019/053212, entitled "LOFT CONVERSION" and filed on 13 Nov. 2019, which claims priority to GB Patent Application No. 1818470.5 filed on 13 November, 2018, each of which are hereby incorporated herein by reference in their entireties.

FIELD

The present invention relates to a system and method for converting roof spaces to habitable living space.

SUMMARY

In recent decades the most common form of domestic roof construction has been one in which ready-made timber trusses are placed on the walls at intervals of 60 cm. Each truss is generally triangular and planar with a W-shaped internal reinforcement. In order to increase the habitable space in a house it is common practice to convert the attic into one or more rooms by inserting a reinforcing structure so that the internal W-shaped reinforcement can be removed. Various methods have been devised for doing this.

One type of method involves laying two longitudinal beams on the base beams of the trusses (i.e. perpendicular to their planes), resting on the gable walls, so that longitudinal stud walls to support the triangle sides can be constructed. Such a technique is shown in FR 2551789. It is not simple to make these beams, and the construction necessitates converting the entire length (width) of the house, which may not be desirable.

Other kinds of method reinforce individual trusses. Such a method is shown in GB 2288843 (Mahon), where panels and plates are applied to the horizontal and inclined components of the triangular trusses. Such a method is labour-intensive. An interesting variant on this theme is to be seen in GB 2407589 (Rowsell), which uses a telescopic box-section beam ("Telebeam") to reinforce the timber joist of the roof truss. The outriggers sit on the wall plate, thus creating a load-bearing floor, but there is no other reinforcement.

The present invention is concerned with converting lofts, especially the trussed type, and more generally with reinforcement of frameworks for building purposes.

According to the invention in one aspect a framework such as a timber truss is reinforced by C-section steel or aluminium frames attached to one or, preferably, both sides of the framework, preferably by bolts passing through the framework.

Preferably the system uses C-section cold-rolled galvanized steel to sandwich the existing truss, thus enabling removal of the inner cords (W-frame). Preferably also stud walls are added, which may also be made of C-sections.

The connection at the corners is particularly important. In order for a C-section to be fixed to another at an angle, one possibility is the removal of the end part of one (the "inner") flange on one beam so that the other beam can be laid in the resulting recess and a bolt is passed through the web of each beam. An alternative is to use C-beams having a rounded or faceted end caps or channel stops, as known from patent number WO 2007/107788 (Thurston), which describes the manufacture of roof frames made of interconnected C-sections. A further alternative uses custom-build corner joints that engage with the open ends of the C-sections.

Systems in accordance with the invention can be used to build both straight up-and-over and dormer conversions of pitched roofs by connecting the steel C-sections in various shapes, all the while sandwiching the entire outer triangular outline of the truss, or at least the base and one side. The system enables two men to perform a loft conversion with no cranes, and scaffolding is not needed. All the components can be fed in through a small exposed gap in the roof, say the bottom 30-60 cm of tiles removed to expose the rafters.

In embodiments of the invention C-section beams sandwich the truss, one on each side, all the way around forming a triangle, or when a dormer is required a four-sided four-cornered shape on every truss outline, enabling the inners of the truss to be cut out so as to open the loft up for use. The connection of the C-sections at the apex of the dormer is likely to be different from the connection at the bottom corners, for instance using an intermediate plate. Each C-beam extends the entire length of its respective frame component, or at least most, perhaps 90%, of the length, if a separate corner component is used.

The intermediate plate is of special design and is also an aspect of the invention. It consists of a generally flat, elongate major face with two extending arms, to be fastened to the vertical sides of an obtuse angle of a frame such as a dormer frame upper corner, and an integral diagonal plate part or gusset at right angles to the plane of the main plate and extending across the obtuse angle, so as to serve as a reinforcement and also as an application surface for plaster along the ceiling edge. Preferably there is such a plate on each side of the frame. In this case the horizontal extent of the gusset is just under half the thickness of the timber (i.e. about 10-13 mm in most cases).

In certain situations there is a C-section reinforcement only on one side of the truss or framework, for instance at the end of the house where there is no room for a beam to be inserted between the truss and the wall, or if the truss is otherwise inaccessible, or if not so much reinforcement is needed.

The invention also covers methods of converting loft or roof space, where C-section metal beams are fastened to the existing timber framework, overlapping at one or both lower corners; fixing the overlapping ends to each other by bolts or other means, and removing inner framework parts of the timber frame, thus freeing roof space.

Where the construction of a dormer extension is included in such a method, it is possible to construct the framework of the dormer before the majority of the roof tiles is removed. This greatly reduces the amount of waterproofing that has to be applied during construction. The bottom row or rows of tiles are removed so that the beams can be inserted, a few tiles are removed to make passage holes for the beams at ceiling level, and the framework is constructed. This is possible because no large beams need to be inserted, as in the prior-art side-to-side method.

Finally, the invention concerns roofs constructed using the reinforcements as described herein, and to methods of converting timber-framed roofs using the reinforcements.

BRIEF DESCRIPTION OF THE DRAWINGS

For a better understanding of the invention, embodiments will now be described by way of example with reference to the attached drawings, in which.

DETAILED DESCRIPTION

Figure 1:
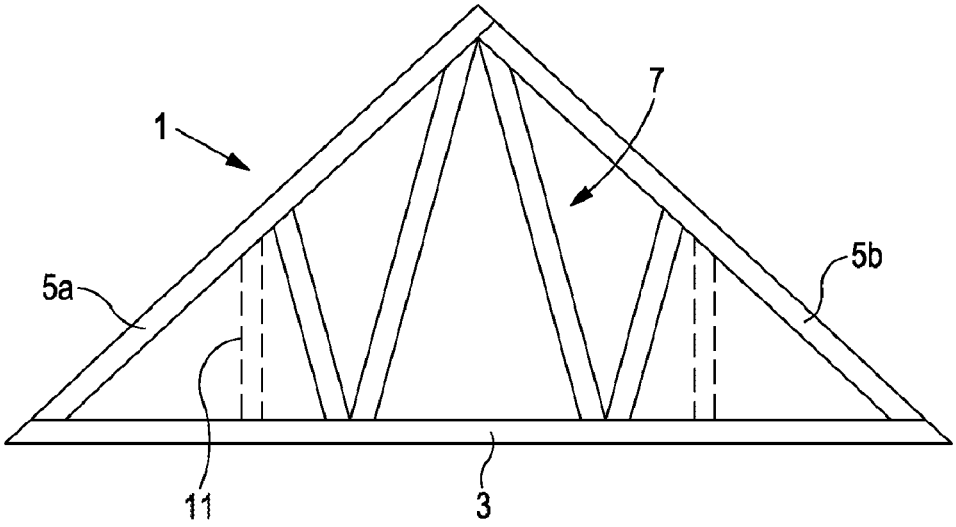
FIG. 1 is a view of a standard timber roof truss.

As shown in FIG. 1, a standard ("Fink") roof truss 1 is a planar framework, generally (isosceles) triangular in outline, resting on the long side, with two usually equal shorter sides 5*a*, 5*b*, extending at an angle of about 40° to the base 3. Since the timber for a typical domestic roof is only about 3×1" (76×25 mm) in section it needs reinforcement in the form of a W-shaped integral stiffening 7, in order to support the roof. Such trusses rest on the house walls and are spaced longitudinally (perpendicular to the page) at intervals of 600 mm.

FIG. 1 also shows in dashed lines how the sides 5 would need to be supported if the W-reinforcement were to be removed for a loft conversion.

Figure 2:
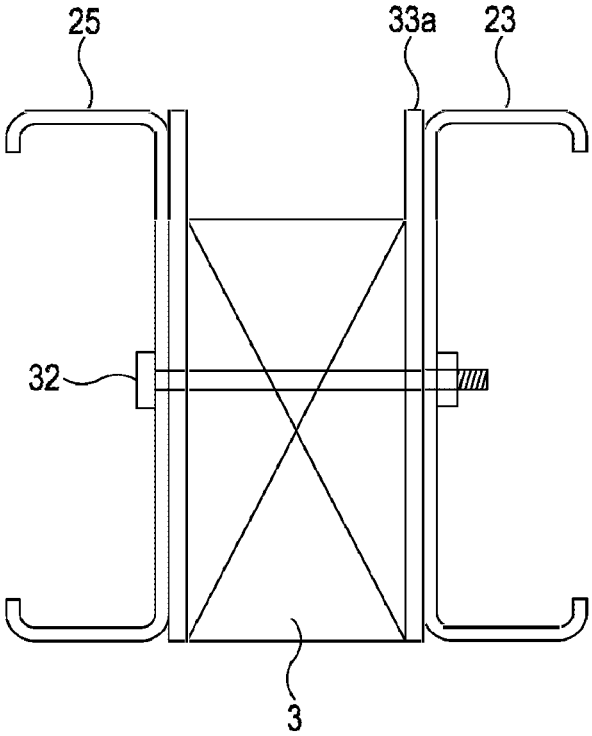
FIG. 2 is a cross-section of the kind of reinforcement used in embodiments of the invention.

In embodiments of the invention such a vertical intermediate support or pillar is not needed, though it can also be present since the corner space is not generally used. Instead the outer triangular frame itself is reinforced with steel sections, generally speaking C-sections, as shown in FIG. 2. These sections follow the triangular outline of the truss and so reinforce it all round, or at least round the remaining parts of the outline, if some is removed e.g. 30 for a dormer window. The "back" or straight part of the C-section lies against the timber, the concave part facing outward.

Preferably two such sections 23, 25 are bolted to the frame part (here the base 3 is shown), back to back on either side of the truss and held together by a set of bolts 32 to sandwich the timber. The sections may, as here, be somewhat taller (i.e. deeper, in the plane of the truss) than the timber itself.

Figure 3:
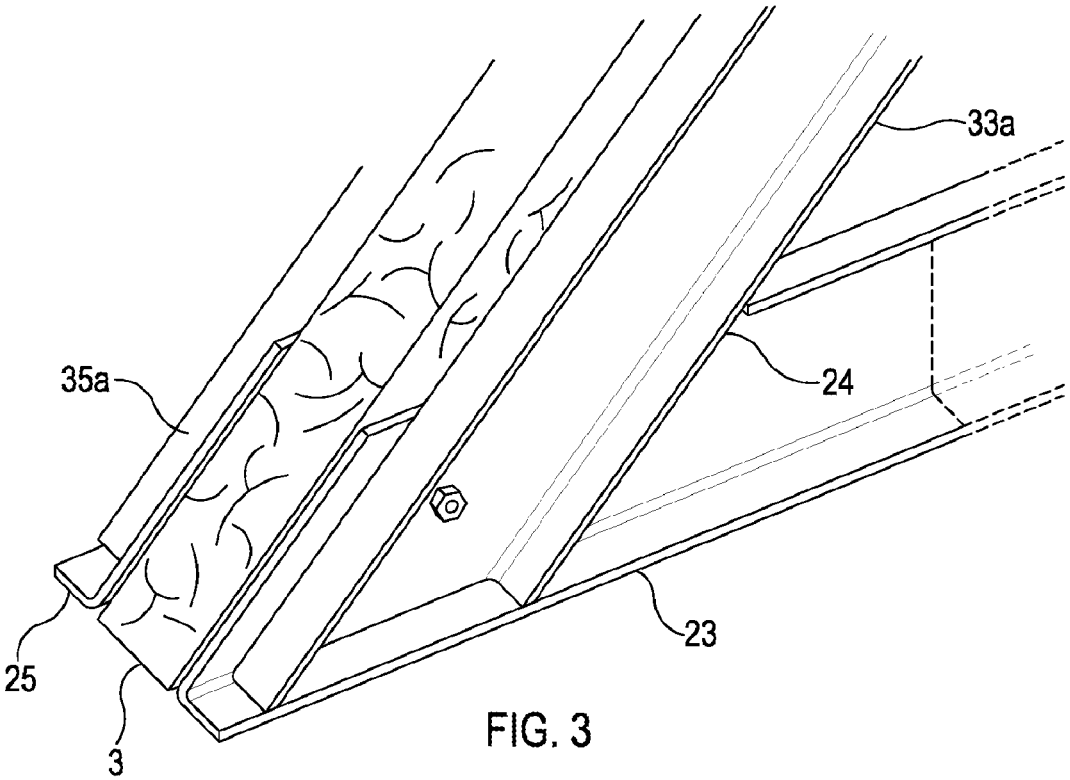
FIG. 3 shows a detail of a corner reinforcement in accordance with the invention.

FIG. 2 also shows a section though another metal plate between the timber and the horizontal beam; this is the similar C-section reinforcement 33*a* of the inclined frame part 5*a*, as shown in FIG. 3. For the frame to be sufficiently stiff it is important for the reinforcements to overlap at the corners. Since the C-sections would otherwise interfere with each other, a cut-out 24 is made in the top flange (the inner flange, with respect to the acute joint angle) of the horizontal beam 23 to accommodate the end of the inclined beam 33*a*, so that the beams lie flush against each other; similarly on the other side (not shown), where a recess is made by cutting away the end, perhaps the last 15-20 cm, of the top flange of the beam 25, into which recess the inclined beam 35*a* fits. It can also be seen that the ends of the beams are inclined to match the overall shape of the truss (or roof).

Figure 4:
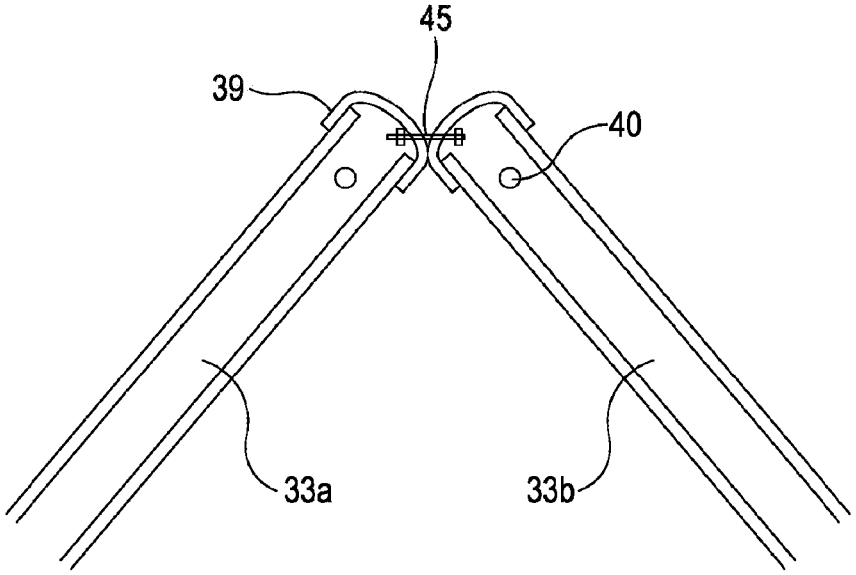
FIG. 4 shows an apex reinforcement.

FIG. 4 shows how the two side supports of a truss are joined at the apex. This joint is made using fitted ends 39 that close off the open ends of the C-channels and are curved or faceted so that they have surfaces that meet for a wide range of relative angles of the two beams 33*a*, 33*b*. At the point of meeting the two beams are fastened together by a bolt 45, a very simple operation. Such designs have been used before for new steel roof constructions, as in GB 2449832, but not, to the applicant's knowledge, for reinforcement.

The resulting truss is thus reinforced along its entire outer triangular outline by steel sandwiching it on both sides, and the W-bracing can be removed, allowing the roof space to be exploited. A stud wall can be built up as shown by the dotted lines in FIG. 1, but it is not needed for support purposes. The trusses at the ends, or at least at the partition-wall end of a semi-detached house, may not be accessible from the far side, so such a truss may be reinforced only on one side by C-beams. Indeed, this is generally the case, but usually a sandwich is better.

Figure 5:
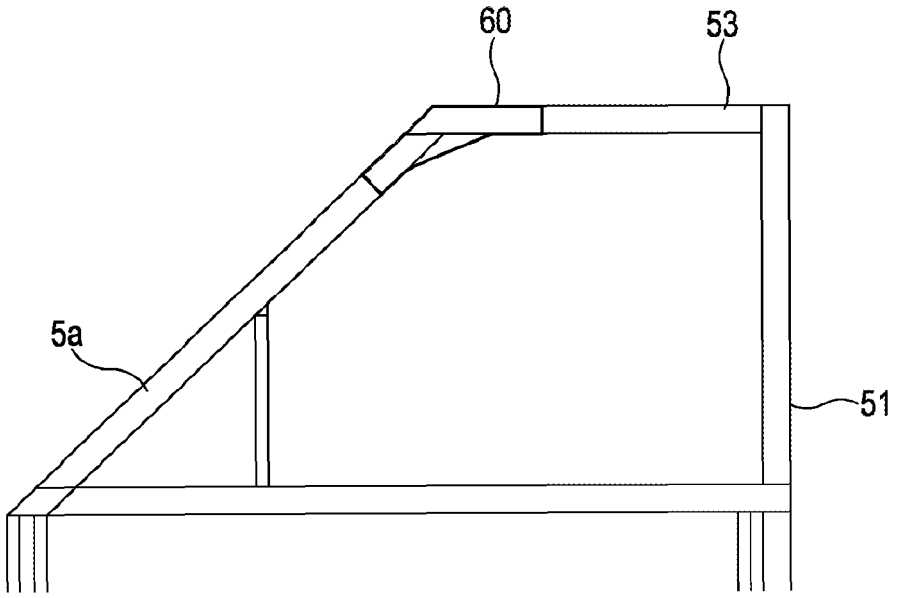
FIG. 5 shows a variant where a dormer window is to be included in the conversion.
Figure 6:
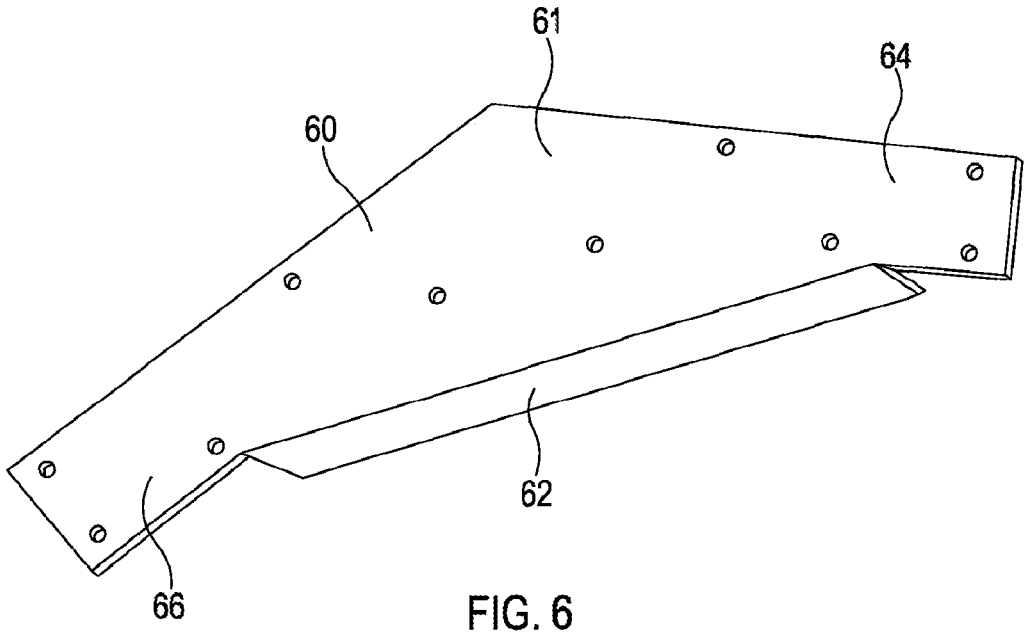
FIG. 6 is a detail of the reinforcement plate used in FIG. 5.

If a dormer window is to be included for the conversion, then one or more of the inclined rafters 5*b* will also be removed and replaced by horizontal and vertical beams 51, 53. This is shown in FIG. 5. To take the weight of the roof, which tends to push the structure to the right in FIG. 5, the apex joint between the remaining rafter 5*a* and the horizontal dormer frame 53 is reinforced by an angled plate 60, shown in detail in FIG. 6. A similar plate is present on the other side of the apex joint of the timber framework. The C-section 33*a* (not shown) lies on top of the plate on each side.

The plate 60 has a central part 61 straight at one side and angled at an obtuse angle at the other, with two arms 64 and 66 extending at that obtuse angle so as to follow the apex joint, and an upstanding flange 62 in a plane perpendicular to the plate and facing inwardly with respect to the frame, facilitating the application of plasterboard for the internal finishing and also serving as reinforcement. The plate can be made of galvanised steel 1-3 mm thick, and is in the region of 25-40 cm long, between the ends of the arms. Holes are provided distributed over its area to allow fixing to the framework.

The procedure for converting the loft space is typically as follows. Two (or more if needed) rows of tiles are removed, preferably near the lower end of the roof, to allow access to the roof space from outside, in order to insert the C-beams and other components. First the dimensions of the trusses are measured. Then C-beams are cut to size, which can be done on site. Recesses in the ends of the horizontal beams are cut out to allow the interlocking as shown in FIG. 3. Holes are drilled in the timber as required, the various C-section beams are inserted and applied to the frame, and the bottom corners are bolted together, followed by the apex.

Figure 9:
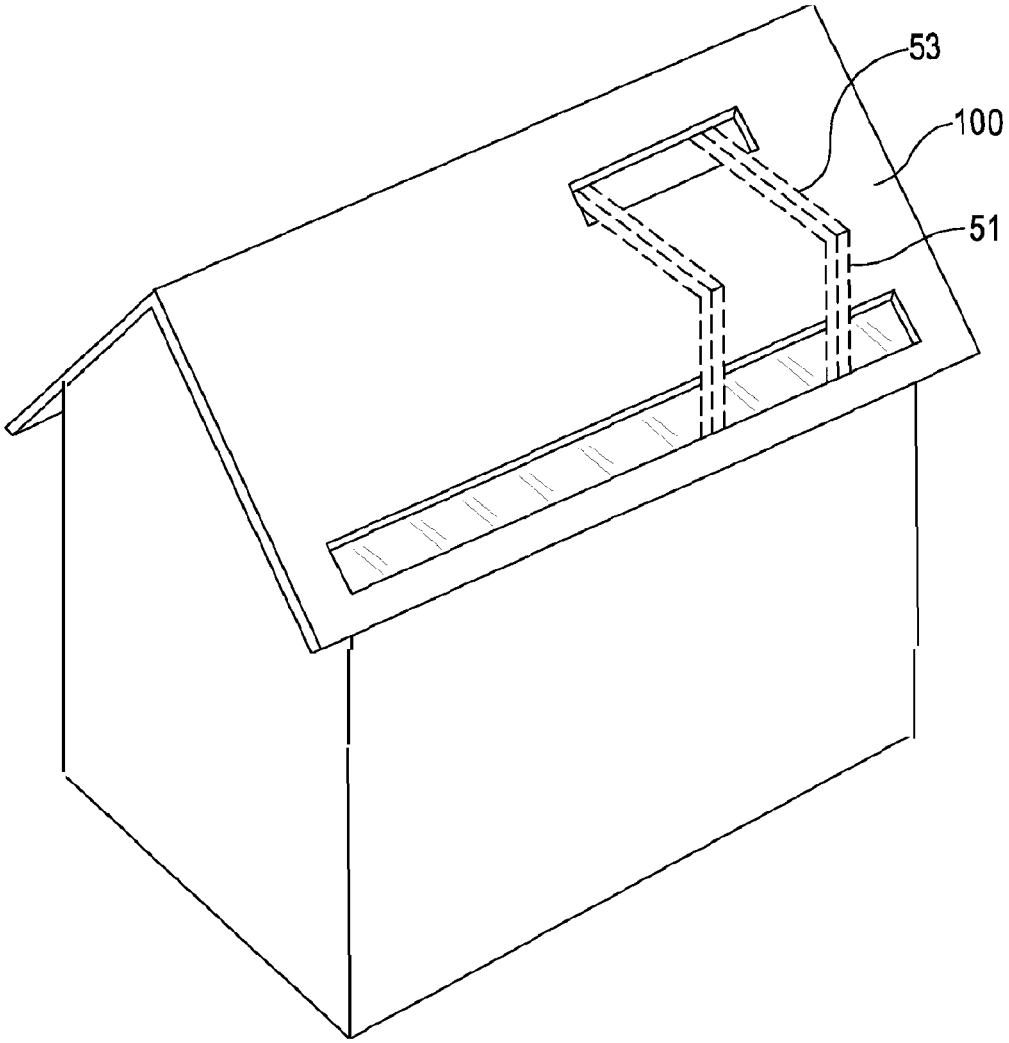
FIG. 9 shows a method of constructing a roof conversion with a dormer in accordance with the invention.

If a dormer window is being fitted, tiles are also removed near the top to allow the timber beam construction to be made. Rafters 5*b* are removed, wholly or partly, from one side, and Vertical 51 and horizontal 53 beams are fitted to create the shape of the dormer, the horizontal beam 53 meeting the remaining rafter on the other side of the roof (FIG. 5). Plates 60 are applied to the apex (joint of horizontal beam 53 and existing rafter 5*a*). A dormer process is shown very schematically in FIG. 9. Then the W-reinforcements, if present, are removed, as is the remainder of the roof within the dormer. The structure is then ready for the application of a stud wall and finishing. The diagonal flanges 62 of the plates 60 provide a smooth base for attaching plasterboard for the ceiling.

The dormer process and plates 60 can also be used with any means of reinforcing the lower corner of the trusses, though clearly the described C-beam method is ideal.

Figure 7:
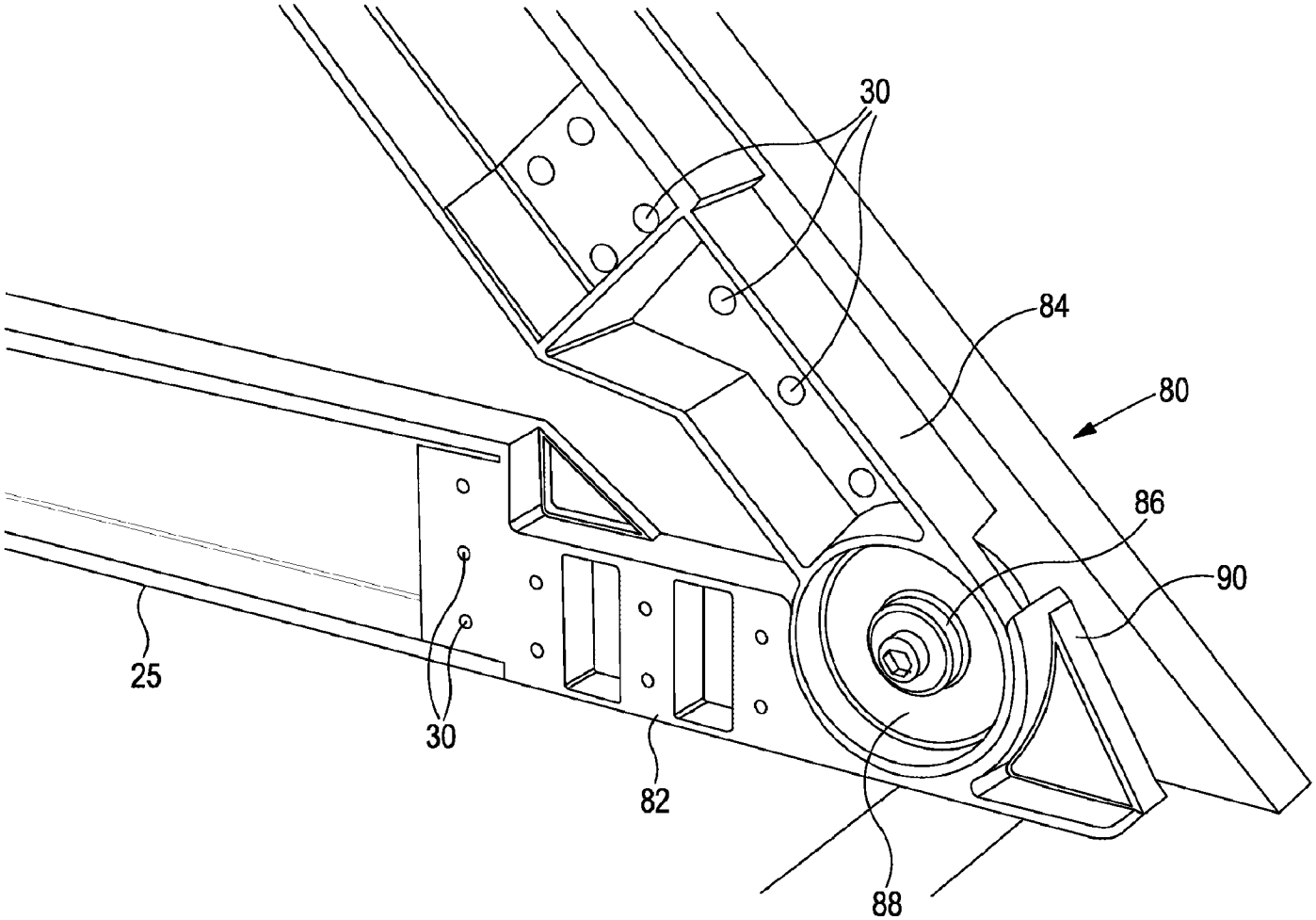
FIG. 7 is an alternative embodiment of a joint between two C-sections, using a custom component.

FIG. 7 shows an alternative way, within the scope of the invention, of fixing two C-beams together at a vertex, in fact at all three vertices of the triangular truss. The C-beams are joined using a hinge piece or knuckle joint 80. In FIG. 7 an end reinforcement is shown, so there is no corresponding reinforcement on the other side, but for all the intermediate trusses such a sandwiching configuration would generally be present.

The knuckle joint 80 is in two parts, each with a hinge plate 88, 90 together defining a pivot 86 and an extending legs 82 and 84. The free ends of the legs fit inside the respective C-sections, e.g. 25, 35*a*, and the assembly is then bolted to the section of the truss by bolts through holes 30, namely at least the lower corners and, as here, preferably the upper vertex.

Figure 8:
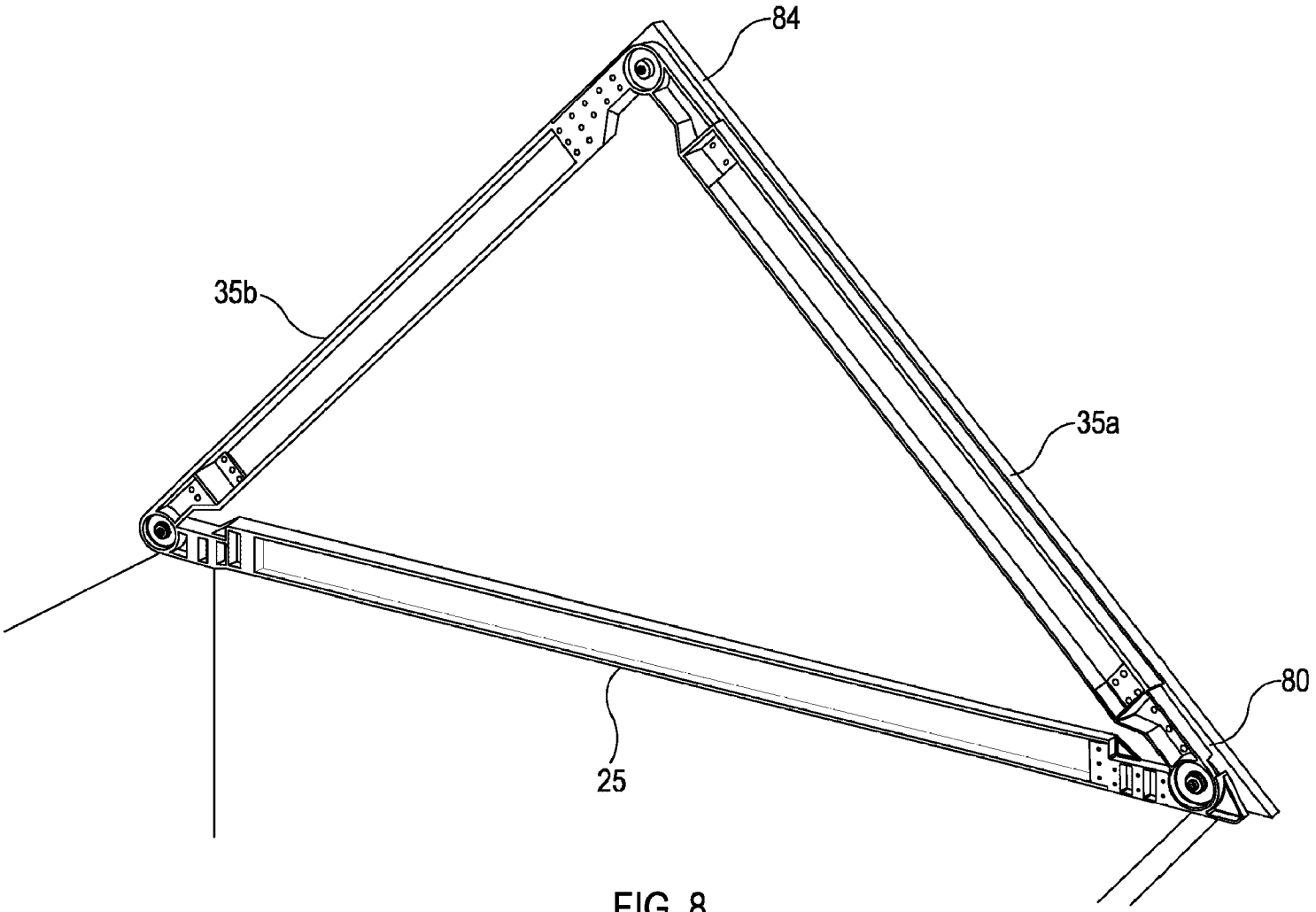
FIG. 8 shows the embodiment of FIG. 7 in situ on a complete truss.

During the assembly process, C-section beams are cut to length on site and joints 80 are applied to their ends. The C-beams here are somewhat shorter than the lengths of timber that they reinforce, and than the beams in the first embodiment, since the remainder of the length is provided by the legs of the knuckle joint. Here of course there is no need to remove part of the flange of the C-section. The angle of the joint is adjusted so that the C-sections lie alongside the horizontal and sloping sides of the truss, and the beams and joints are bolted to the truss, resulting in the arrangement shown in FIG. 8.

Where, as for the intermediate trusses, there is a reinforcing frame on each side of the truss, these are bolted to each other by bolts passing through the timber frame of the truss.

Some Innovations Include:

1. A given reinforcing plate for the inner apex corner of a dormer framework, the plate having a central part with two arms extending at an obtuse angle, means to attach the plate to the said apex corner, and an upstanding flange to the inward (obtuse-angled) side of the central part, serving to reinforce the plate and to afford a surface for later application of finishing when the dormer is complete.
2. A method of installing a dormer in a timber roof, comprising:
   - removing the tiles or other roof covering to allow access to the timber frame of the roof;
   - removing one or more rafters where the dormer is to be fitted;
   - replacing the or each removed rafter by horizontal and vertical timber sections to form the dormer, the horizontal section extending from the frame where the rafter was removed; and
   - joining the horizontal section to the remaining rafter on the other side of the roof using one or more plates configured in accordance with the above noted given reinforcing plate.
3. A method of converting a timber-framed roof, comprising:
   - fastening C-section metal beams to at least one side of the existing timber framework, the beams overlapping or nearly meeting at one or both lower corners of the framework;
   - fixing the overlapping ends of the beams to each other by bolts or by a hinge piece; and
   - removing any inner framework parts of the timber frame.
4. A method according to innovation 3, in which metal beams are applied to both sides of the framework.
5. A method according to innovation 3, in which the beams overlap and the end of one flange of one beam is removed so that the other beam can lie against that beam in a flush manner.
6. A method according to innovation 3, in which the roof covering is removed only to a vertical extent of about 30-60 cm, and the components for the conversion are passed through the aperture thus made in the roof.

The invention claimed is:

1. A timber framework for a roof having at least one corner where two timber beams meet, each of the timber beams reinforced by a C-section metal beam having a central web and a pair of flanges forming the C-section, affixed to one or both respective sides of the timber framework, each C-section beam with its central web in contact with only one side of one of the timber beams and its pair of flanges facing outward in a common direction from the timber framework, in which at the at least one corner of the framework the C-sections overlap and at least one outwardly projecting C-section flange is locally removed to allow contact between the central web.

2. The timber framework according to claim 1, in which the framework is generally triangular.

3. The timber framework according to claim 2, in which the framework has one side of the triangle missing and a frame for a dormer inserted.

4. The timber framework according to claim 1, in which the metal beams follow the outline of the framework.

5. The timber framework according to claim 1, in which the fixing includes bolts passing through the framework.

6. The timber framework according to claim 1, in which, at at least one of the corners of the framework, the C-sections are joined together by a hinge piece which has two legs engaging with the respective C-sections.

7. The timber framework according to claim 1, in which, at at least one of the corners, the C-sections that meet there have end caps with inclined or rounded surfaces so that the end caps abut and can be bolted together.

8. The timber framework according to claim 1, including a dormer part, the upper, obtuse, joint of which is additionally reinforced by a plate on at least one side, the plate having an upstanding reinforcing flange forming a diagonal in the obtuse joint region.

9. The timber framework according to claim 1, in which the metal beams are deeper than the framework as seen in the plane of the framework.

10. A roof structure comprising reinforced timber frameworks, at least one of the reinforced timber frameworks having at least one corner where two timber beams intersect, each of the timber beams reinforced by a C-section metal beam affixed to one or both sides of the timber framework, each C-section beam with a central web in contact with only one side of one of the timber beams and a pair of flanges facing outward in a common direction from the timber framework, in which at the at least one corner of the framework the C-sections overlap and at least one outwardly projecting C-section flange is locally removed to allow contact between the central webs.

11. The roof structure according to claim 10, in which the framework is generally triangular.

12. The roof structure according to claim 11, in which the framework has one side of the triangle missing and a frame for a dormer inserted.

13. The roof structure according to claim 10, in which the metal beams follow the outline of the framework.

14. The roof structure according to claim 10, in which the fixing includes bolts passing through the framework.

15. The roof structure according to claim 10, in which, at at least one of the corners of the framework, the C-sections are joined together by a hinge piece which has two legs engaging with the respective C-sections.

16. The roof structure according to claim 10, in which, at at least one of the corners, the C-sections that meet there have end caps with inclined or rounded surfaces so that the end caps abut and can be bolted together.

17. A roof framework including an inner apex corner where two timber beams meet at an obtuse angle, the inner apex corner reinforced by a metal plate having a central part overlaying a side surface of the inner apex corner and having two arms that extend at the obtuse angle along the beams, means to attach the plate to the inner apex corner, and an upstanding flange that orthogonally extends from an inward (obtuse-angled) side of the central part, serving to reinforce the plate and extend into the obtuse-angled space between the beams on an interior side of the roof framework so as to afford a surface for later application of finishing when the roof framework is complete.

18. The roof framework according to claim 17, in which the two timber beams at the inner apex corner are reinforced on each side by such a plate.

19. The roof framework according to claim 17, in which the plate is fixed to the roof framework by screws.

* * * * *